US012077721B2

(12) United States Patent
Yamazaki et al.

(10) Patent No.: US 12,077,721 B2
(45) Date of Patent: Sep. 3, 2024

(54) GREASE COMPOSITION FOR SPEED REDUCER PART OF ON-VEHICLE ELECTRIC COMPONENT

(71) Applicant: Kyodo Yushi Co., Ltd., Fujisawa (JP)

(72) Inventors: Satoshi Yamazaki, Fujisawa (JP); Yoshiyuki Nagasawa, Kameyama (JP); Daisuke Tsutsui, Yokohama (JP); Osamu Nakamura, Kiryu (JP); Hiroyuki Yoshida, Kiryu (JP); Tsubasa Ishizeki, Kiryu (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 13 days.

(21) Appl. No.: 17/762,140

(22) PCT Filed: Oct. 16, 2020

(86) PCT No.: PCT/JP2020/039112
§ 371 (c)(1),
(2) Date: Mar. 21, 2022

(87) PCT Pub. No.: WO2021/075553
PCT Pub. Date: Apr. 22, 2021

(65) Prior Publication Data

US 2022/0340833 A1 Oct. 27, 2022

(30) Foreign Application Priority Data

Oct. 16, 2019 (JP) ..... 2019-189136

(51) Int. Cl.

| | |
|---|---|
| ***C10M 169/02*** | (2006.01) |
| ***C10M 101/02*** | (2006.01) |
| ***C10M 107/02*** | (2006.01) |
| ***C10M 111/04*** | (2006.01) |
| ***C10M 115/08*** | (2006.01) |
| *C10N 20/02* | (2006.01) |
| *C10N 40/00* | (2006.01) |
| *C10N 50/10* | (2006.01) |

(52) U.S. Cl.
CPC ..... *C10M 169/02* (2013.01); *C10M 101/02* (2013.01); *C10M 107/02* (2013.01); *C10M 111/04* (2013.01); *C10M 115/08* (2013.01); *C10M 2203/1006* (2013.01); *C10M 2205/0206* (2013.01); *C10M 2215/1026* (2013.01); *C10N 2020/02* (2013.01); *C10N 2040/40* (2020.05); *C10N 2050/10* (2013.01)

(58) Field of Classification Search
CPC ..... C10M 169/02; C10M 101/02; C10M 107/02; C10M 111/04; C10M 115/08; C10M 2203/1006; C10M 2205/0206; C10M 2215/1026; C10M 2203/1025; C10M 2205/0285; C10M 2207/026; C10M 107/04; C10N 2020/02; C10N 2040/40; C10N 2050/10; C10N 2030/02; C10N 2030/68; C10N 2030/74; C10N 2030/08; C10N 2040/02; C10N 2040/04
See application file for complete search history.

(56) References Cited

U.S. PATENT DOCUMENTS

| | | | | |
|---|---|---|---|---|
| 5,952,273 | A | 9/1999 | Suzuki et al. | |
| 9,404,061 | B2 | 8/2016 | Yashinari | |
| 10,081,778 | B2 | 9/2018 | Tsutsui et al. | |
| 10,947,477 | B2 | 3/2021 | Yoshinari et al. | |
| 2004/0242439 | A1* | 12/2004 | Mikami | F16C 33/6633 508/552 |
| 2010/0087344 | A1* | 4/2010 | Saita | C10M 169/06 508/438 |
| 2013/0281331 | A1 | 10/2013 | Bardin | |

(Continued)

FOREIGN PATENT DOCUMENTS

| | | | |
|---|---|---|---|
| CN | 103210070 | A | 7/2013 |
| CN | 104755599 | A | 7/2015 |

(Continued)

OTHER PUBLICATIONS

Gao, et al., "Advancement of High Temperature Grease", Lubrication Engineering, No. 1 (Serial No. 173), Jan. 2006, pp. 164-173, with partial English translation. (cited in Office Action dated Aug. 30, 2022, for Chinese Application No. 202080071513.5).

(Continued)

*Primary Examiner* — Cephia D Toomer
(74) *Attorney, Agent, or Firm* — Panitch Schwarze Belisario & Nadel LLP

(57) ABSTRACT

The invention provides a grease composition for a speed reducer part of an on-vehicle electric component, the grease composition containing a base oil and a thickener, wherein the base oil is poly-α-olefin or a mixed oil of poly-α-olefin and mineral oil having a kinematic viscosity of 4 to 19 $mm^2/s$ at 100° C. and a pour point of −30° C. or lower, the thickener is a mixture of a diurea compound expressed by formula (1) and a diurea compound expressed by formula (2)

$$R_1—NHCONH—R_2—NHCONH—R_1 \quad (1)$$

$$R_3—NHCONH—R_2—NHCONH—R_3 \quad (2)$$

wherein $R_1$ is a straight-chain alkyl group having 8 or 18 carbon atoms, $R_2$ is a divalent aromatic hydrocarbon group having 6 to 15 carbon atoms, and $R_3$ is an aryl group having 6 to 7 carbon atoms, and a penetration of the grease composition is 220 to 280.

7 Claims, No Drawings

(56) References Cited

U.S. PATENT DOCUMENTS

| | | | |
|---|---|---|---|
| 2015/0307805 | A1 | 10/2015 | Kanda et al. |
| 2017/0130157 | A1 | 5/2017 | Asai et al. |

FOREIGN PATENT DOCUMENTS

| | | | |
|---|---|---|---|
| CN | 104755600 | A | 7/2015 |
| CN | 105008738 | A | 10/2015 |
| CN | 108779412 | A | 11/2018 |
| EP | 2489721 | A1 | 8/2012 |
| EP | 2631284 | A1 | 8/2013 |
| EP | 2749631 | A1 | 7/2014 |
| EP | 2927523 | A1 | 10/2015 |
| JP | H10273692 | A | 10/1998 |
| JP | 2002371290 | A | 12/2002 |
| JP | 2004250481 | A | 9/2004 |
| JP | 2005-298629 | A | 10/2005 |
| JP | 2013-035882 | A | 2/2013 |
| JP | 2014501292 | A | 1/2014 |
| JP | 2014-108997 | A | 6/2014 |
| JP | 2015-140415 | A | 8/2015 |
| JP | 2019-172760 | A | 10/2019 |
| WO | 2006095809 | A1 | 9/2006 |
| WO | 2007007664 | A1 | 1/2007 |
| WO | 2016114387 | A1 | 7/2016 |
| WO | 2019/009058 | A1 | 1/2019 |

OTHER PUBLICATIONS

Liu, et al., "Progress of research on polyurea grease", Chemical Industry and Engineering Progress, Issue 1, vol. 28, 2009, pp. 51-61, with partial English translation. (cited in Office Action dated Aug. 30, 2022, for Chinese Application No. 202080071513.5).

Extended European Search Report dated Dec. 14, 2022, issued by the European Patent Office in corresponding European Application No. 20876166.8 (9 pages).

International Search Report (PCT/ISA/210) with an English translation, and Written Opinion (PCT/ISA/237) issued on Dec. 28, 2020, by the Japanese Patent Office as the International Searching Authority for International Application No. PCT/JP2020/039112.

Li, "Practice Book for RefiningTechnology, Process Flow And Quality Control of Latest Paraffin, Lubricating Oil and Lubricating Agent (Grease)", CD Publishing and Distribution: Contemporary China Audiovisual Press, Jul. 31, 2004, p. 389, with English translation.

Decision on Rejection issued on Aug. 23, 2023, by State Intellectual Property Office of China in corresponding Chinese Patent Application No. 202080071513.5, with English translation of the Decision. (17 pages).

* cited by examiner

GREASE COMPOSITION FOR SPEED REDUCER PART OF ON-VEHICLE ELECTRIC COMPONENT

TECHNICAL FIELD

The present invention relates to a grease composition for a speed reducer part of an on-vehicle electric component.

BACKGROUND ART

In recent years, there is a demand for reducing the size (increasing the speed reduction ratio) and increasing the output of on-vehicle electric components such as an opening-closing body drive motor, a wiper motor, a power seat motor, or a door mirror motor to achieve weight reduction of components for the purpose of an improvement in fuel consumption of a vehicle. With this demand, grease used in speed reducer parts of the on-vehicle electric components is also required to deal with harsher usage conditions than those of conventional grease such as increased speed, increased surface pressure, and expanding of a usage temperature range to the high-temperature side. Particularly, increasing of life under a high-speed condition is one of significant challenges. In order to increase the life under the high-speed condition, the grease is required not to be dispersed and to attach to and remain on the speed reducer part even if a speed reducer rotates. Moreover, the grease is required to deal with expansion of the usage temperature range not only to the high temperature side but also to the lower temperature side than the conventional grease. Particularly, reduction of starting voltage at low temperature is also one of significant challenges.

A technique of improving adhesiveness by including a viscosity increaser in grease is known (Patent Literature 1). A low-temperature property is generally improved by reducing the kinematic viscosity of a base oil in grease or by increasing the penetration of grease.

CITATION LIST

Patent Literature

Patent Literature 1: Published Japanese Translation of PCT International Application No. 2014-501292

SUMMARY OF INVENTION

Problem to be Solved by the Invention

The present inventors prepared a composition described in Example E of Patent Literature 1 and used a test ring with a diameter of 50 mm to evaluate the composition at the number of revolutions of 400 rpm. As a result, the adhesiveness of the grease decreased. This decrease is assumed to have occurred as a result of a viscosity increaser included in the grease receiving shear force in a test portion and being oriented. In order to increase the life of a speed reducer under a high-speed condition, it is necessary to prevent the grease from being dispersed and prevent a lubrication portion from starving even if the speed reducer rotates at high speed. Moreover, the low-temperature property of the grease also decreased. This decrease is assumed to have occurred due to an increase in the viscosity of the viscosity increaser in a low-temperature environment. When the kinematic viscosity of the base oil was reduced or the penetration of the grease was increased to improve the low-temperature property of the grease, the adhesiveness of the grease decreased.

In view of above, a problem to be solved by the present invention is to provide a grease composition for a speed reducer part of an on-vehicle electric component that achieves a good balance between a low-temperature property and adhesiveness under a high-speed condition.

Means for Solution of the Problems

For the problem of achieving a good balance between a low-temperature property and adhesiveness under a high-speed condition, the present inventors achieved this balance by causing a penetration of a grease composition to be within a specific range by using specific diurea compounds together as a thickener and using poly-α-olefin ("PAO") or a mixed oil of PAO and mineral oil that has a kinematic viscosity and a pour point within specific ranges as a base oil. Specifically, the present invention provides the following grease composition.

[1] A grease composition for a speed reducer part of an on-vehicle electric component, the grease composition containing a base oil and a thickener, wherein the base oil is poly-α-olefin or a mixed oil of poly-α-olefin and mineral oil having a kinematic viscosity of 4 to 19 $mm^2/s$ at 100° C. and a pour point of −30° C. or lower, the thickener is a mixture of a diurea compound expressed by formula (1) and a diurea compound expressed by formula (2)

$$R_1—NHCONH—R_2—NHCONH—R_1 \quad (1)$$

$$R_3—NHCONH—R_2—NHCONH—R_3 \quad (2)$$

wherein $R_1$ is a straight-chain alkyl group independently having 8 or 18 carbon atoms, $R_2$ is a divalent aromatic hydrocarbon group having 6 to 15 carbon atoms, and $R_3$ is an aryl group having 6 to 7 carbon atoms, and a penetration of the grease composition is 220 to 280.

[2] The grease composition according to the above-described [1], wherein a mixed ratio of the diurea compounds is (1):(2)=9:1 to 5:5 in mass ratio.

[3] The grease composition according to the above-described [1] to [2], wherein the on-vehicle electric component is an opening-closing body drive motor, a wiper motor, a power seat motor, or a door mirror motor.

Advantageous Effects of Invention

The present invention can provide a grease composition for a speed reducer part of an on-vehicle electric component that achieves a good balance between a low-temperature property and adhesiveness under a high-speed condition. This can increase the life of a speed reducer of the on-vehicle electric component and reduce starting voltage of a motor of the speed reducer at low temperature. Moreover, the composition of the present invention has excellent heat resistance. This can improve durability of the speed reducer part of the on-vehicle electric component.

DESCRIPTION OF EMBODIMENT

[Mixture of Aliphatic Diurea and Aromatic Diurea]

A thickener used in a grease composition of the present invention is a mixture of a diurea compound expressed by formula (1) below and a diurea compound expressed by formula (2) below.

$$R_1—NHCONH—R_2—NHCONH—R_1 \quad (1)$$

$$R_3—NHCONH—R_2—NHCONH—R_3 \quad (2)$$

(in the formulae, $R_1$ is a straight-chain alkyl group independently having 8 or 18 carbon atoms, $R_2$ is a divalent aromatic hydrocarbon group having 6 to 15 carbon atoms, and $R_3$ is an aryl group having 6 to 7 carbon atoms)

The compound of formula (1) may be a compound in which both $R_1$ are a straight-chain alkyl group having 8 carbon atoms, both $R_1$ are a straight-chain alkyl group having 18 carbon atoms, or one $R_1$ is a straight-chain alkyl group having 8 carbon atoms while the other $R_1$ is a straight-chain alkyl group having 18 carbon atoms. The compound of formula (1) is preferably the compound in which both $R_1$ are the straight-chain alkyl group having 8 carbon atoms from the viewpoint of adhesiveness.

The compound of formula (2) is preferably a compound in which $R_3$ is a tolyl group.

The $R_2$ in formula (1) and formula (2) is preferably a group derived from tolylene diisocyanate or diphenylmethane-4,4'-diisocyanate, more preferably the group derived from diphenylmethane-4,4'-diisocyanate.

The compound of formula (1) is more preferably a compound in which $R_1$ is the straight-chain alkyl group having 8 carbon atoms and $R_2$ is the group derived from diphenylmethane-4,4'-diisocyanate. The compound of formula (2) is more preferably a compound in which $R_3$ is the tolyl group and $R_2$ is the group derived from diphenylmethane-4,4'-diisocyanate. A mixture of these compounds is most preferable.

A diurea-based thickener is generally obtained by reacting isocyanate and amine that are raw materials in a base oil. The thickener of the present invention can be obtained by separately preparing the diurea compound (belonging to so called "aliphatic diurea") that is expressed by formula (1) and in which the raw material amine is octylamine and/or stearylamine and the diurea compound (belonging to so-called "aromatic diurea") that is expressed by formula (2) and in which the raw material amine is aromatic amine in the base oil and then mixing the prepared compounds. The thickener of the present invention is different from a thickener obtained by reacting a mixture of aliphatic amine and aromatic amine with isocyanate.

A mass ratio between the diurea compound expressed by formula (1) and the diurea compound expressed by formula (2) is preferably (1):(2)=9:1 to 5:5, more preferably 9:1 to 7:3, even more preferably 9:1 to 8:2. The mass ratio being within such a range is preferable because, in such a case, the grease has excellent adhesiveness to a speed reducer part under a high-speed condition.

The content of the thickener in the grease composition of the present invention is preferably 5 to 30 mass %, more preferably 5 to 20 mass %, and even more preferably 8 to 20 mass %. The content of the thickener being within such a range is preferable because, in such a case, the adhesiveness is good.

The composition of the present invention preferably includes no thickener other than the mixture described above.

[Poly-α-Olefin or Mixed Oil of Poly-α-Olefin and Mineral Oil]

The base oil used in the grease composition of the present invention is PAO alone or a mixed oil of PAO and mineral oil.

The kinematic viscosity of the base oil at 100° C. is 4 to 19 $mm^2/s$, preferably 6 to 15 $mm^2/s$, more preferably 8 to 15 $mm^2/s$. When the kinematic viscosity of the base oil at 100° C. is 4 $mm^2/s$ or more, a grease composition with excellent heat resistance can be obtained. When the kinematic viscosity of the base oil at 100° C. is 19 $mm^2/s$ or less, a grease composition with an excellent low-temperature property can be obtained. Particularly, when the kinematic viscosity of the base oil is 6 to 15 $mm^2/s$ or 8 to 15 $mm^2/s$, it is possible to obtain the grease composition with both of acceptable low-temperature performance and acceptable heat resistance. In the case of the mixed oil, the kinematic viscosity of each of PAO and the mineral oil is not limited to particular viscosity as long as the kinematic viscosity of the whole base oil is within the aforementioned range. However, using PAO with kinematic viscosity of 4 to 100 $mm^2/s$ at 100° C. and mineral oil with kinematic viscosity of 6 to 15 $mm^2/s$ at 100° C. together can achieve an excellent low-temperature property and is thus preferable.

The pour point of the base oil is −30° C. or lower. When the pour point of the base oil is −30° C. or lower, a grease composition with an excellent low-temperature property can be obtained.

When the base oil of the present invention is the mixed oil of PAO and the mineral oil, the proportion of each oil is not limited to a particular proportion as long as the kinematic viscosity at 100° C. and the pour point are within the aforementioned ranges. In the case of the mixed oil, PAO: mineral oil (mass ratio) is more preferably 9:1 to 5:5, even more preferably 9:1 to 6:4. The mass ratio being within such a range is preferable because, in such a case, the low-temperature property is excellent.

The content of the base oil in the grease composition of the present invention is preferably 70 to 90 mass %, more preferably 80 to 90 mass %, even more preferably 80 to 90 mass %. The content of the base oil being within such a range is preferable because, in such a case, the low-temperature property is excellent.

[Other Additives]

The grease composition of the present invention may contain additives normally used in grease as necessary. When the grease composition of the present invention contains additives, the content of the additives is normally 0.5 to 35 mass %, preferably 5 to 25 mass %, more preferably 0.5 to 5% based on the total amount of the grease composition. Such additives include an inorganic passivator, an antioxidant, antirust agent, a metal corrosion inhibitor, an oiliness agent, an antiwear agent, an extreme pressure agent, and solid lubricant. The grease composition preferably contains the antioxidant and the antirust agent among these additives. The inorganic passivator specifically includes sodium nitrite and the like.

The antioxidant includes amine-based, phenol-based, quinoline-based, and sulfur-based antioxidants, zinc dithiophosphate, and the like. The antioxidant is preferably the amine-based or phenol-based antioxidant.

The antirust agent includes zinc-based, carboxylic acid-based, carboxylate salt-based, succinic acid-based, amine-based, and sulfonate salt-based antirust agents. The antirust agent is preferably the succinic acid-based antirust agent, more preferably a succinic anhydride, particularly preferably an alkenyl succinic anhydride (for example, succinic anhydride including an alkenyl group having 12 carbon atoms).

The metal corrosion inhibitor includes thiadiazole-based, benzimidazole-based, and benzotriazole-based metal corrosion inhibitors.

The oiliness agent includes an aliphatic acid, a fatty acid ester, and a phosphoric acid ester.

The antiwear agent and the extreme pressure agent include phosphorus-based, sulfur-based, and organic metal-based agents.

The solid lubricant includes a metal oxide salt, molybdenum disulfide, polytetrafluoroethylene, melamine cyanurate, and graphite.

The grease composition preferably contains no viscosity increaser as the additives.

[Penetration]

The penetration of the grease composition of the present invention is 220 to 280, preferably 235 to 265. Setting the penetration to 220 or more enables obtaining of a grease composition with an excellent low-temperature property and setting the penetration to 280 or less enables obtaining of a grease composition with excellent adhesiveness under a high-speed condition. Note that the term "penetration" in the present specification refers to a 60-stroke worked penetration. The penetration can be measured according to JIS K2220 7.

Among such grease compositions, a grease composition in which a base oil is poly-α-olefin or the mixed oil of poly-α-olefin and the mineral oil having a kinematic viscosity of 13.6 $mm^2/s$ at 100° C. and a pour point of −30° C. or lower, a thickener is the mixture of the compound of formula (1) in which $R_1$ is the straight-chain alkyl group having 8 carbon atoms and $R_2$ is the group derived from diphenylmethane-4,4'-diisocyanate and the compound of formula (2) in which $R_3$ is the tolyl group and $R_2$ is the group derived from diphenylmethane-4,4'-diisocyanate, where the mixing ratio is (1):(2)=9:1 in mass ratio, and the penetration of the grease composition is 250 is preferable because this grease composition has a good balance of the low-temperature property, the adhesiveness under the high-speed condition, and the heat resistance (therefore, lubrication life). It is particularly preferable that this grease composition further contains 0.5 mass % of the phenol-based antioxidant as the antioxidant and 0.5 mass % of the succinic anhydride including the alkenyl group having 12 carbon atoms as the antirust agent.

The grease composition of the present invention can be used in a speed reducer part of an on-vehicle electric component, for example, an opening-closing body drive motor, a wiper motor, a power seat motor, or a door mirror motor. Materials forming these members may be resin or metal. The resin includes polyacetal (POM), aliphatic polyamide (PA6, PA66, and the like), aromatic polyamide (PA6T, PA9T, and the like), polyphenylene sulfide (PPS), and the like. The metal includes steel, copper alloys (brass and the like), and the like. A combination of polyacetal and steel is preferable from the viewpoint of accuracy of dimensions, lubricating property, and cost.

EXAMPLES

Base oils used to prepare grease compositions of Examples and Comparative Examples are as follows.

Poly-α-olefin A ("PAO-A"): Kinematic viscosity at 100° C. is 100.0 $mm^2/s$, pour point is −30° C.

Poly-α-olefin B ("PAO-B"): Kinematic viscosity at 100° C. is 8.0 $mm^2/s$, pour point is −55° C.

Poly-α-olefin C ("PAO-C"): Kinematic viscosity at 100° C. is 4.0 $mm^2/s$, pour point is −65° C.

Poly-α-olefin D ("PAO-D"): Kinematic viscosity at 100° C. is 2.0 $mm^2/s$, pour point is −65° C.

Mineral oil A ("MO-A"): Kinematic viscosity at 100° C. is 11.2 $mm^2/s$, pour point is −15.0° C.

Mineral oil B ("MO-B"): Kinematic viscosity at 100° C. is 31.6 $mm^2/s$, pour point is −12.5° C.

Preparation Example 1 Preparation of Grease Composition in which Thickener is Aliphatic Diurea 4,4'-diphenylmethane diisocyanate and octylamine were reacted at a ratio of 1 mol to 2 mol in the base oil and were cooled to form a base grease.

A phenol-based antioxidant (product name IRGANOX L135, manufactured by BASF Japan Ltd.) 0.5% and an alkenyl succinic anhydride (succinic anhydride including an alkenyl group having 12 carbon atoms) (product name DSA, manufactured by Sanyo Chemical Industries, Ltd.) 0.5% were added to the base grease as the antioxidant and the antirust agent, respectively, and were kneaded with a triple roll mill to prepare a grease composition with a predetermined penetration.

Preparation Example 2 Preparation of Grease Composition in which Thickener is Aromatic Diurea A grease composition was prepared as in Preparation Example 1 except for the point that p-toluidine was used instead of octylamine.

Preparation Example 3 Preparation of Grease Composition in which Thickener is Mixture of Aliphatic Diurea and Aromatic Diurea The base grease obtained in Preparation Example 1 and the base grease obtained in Preparation Example 2 were mixed to prepare a base grease in which the thickener was a mixture of aliphatic diurea and aromatic diurea.

A phenol-based antioxidant (product name IRGANOX L135, manufactured by BASF Japan Ltd.) 0.5% and an alkenyl succinic anhydride (succinic anhydride including an alkenyl group having 12 carbon atoms) (product name DSA, manufactured by Sanyo Chemical Industries, Ltd.) 0.5% were added to the base grease as the antioxidant and the antirust agent, respectively, and were kneaded with a triple roll mill to prepare a grease composition with a predetermined penetration.

The mass % of the thickener in each composition was as illustrated in Tables 1 and 2. The balance is the base oil.

Note that the kinematic viscosity of each base oil at 100° C. was measured according to JIS K2220 23. The pour point of each base oil was measured according to JIS K2269. The penetration of each grease composition was measured according to JIS K2220 7.

The grease compositions obtained above were tested and evaluated in methods described below.

<Evaluation of Adhesiveness by Ring-On-Ring Test>

Test Method

Sample grease was applied at an even thickness on a surface of a ring A, a ring B was placed on the ring A, the rings A and B were rotated at the specified number of revolutions, and then an amount of grease dispersed from the ring surface was measured.

Test Conditions

Ring A

Material: polyacetal (φ50 mm)

Number of revolutions: 400 rpm (V=62.8 m/min)

Ring B

Material: steel (φ25 mm)

Number of revolutions: 800 rpm (V=62.8 m/min)
Load: 10 N (10.7 MPa)
Test temperature: 25° C.
Measurement Item Dispersion rate (%)=grease dispersion amount (mg)/grease application amount (mg)

Criteria
Excellent Adhesiveness accepted: dispersion rate less than 20%
Good Adhesiveness accepted: dispersion rate less than 25%
Poor Adhesiveness failed: dispersion rate 25% or more
Very poor Adhesiveness failed: dispersion rate 30% or more <Evaluation of Low-Temperature Property by Rheometer Test>

Test Method
Sample grease was sandwiched between a cone and a plate and cooled to specified temperature. Then, the cone was rotated and maximum shear stress applied to the plate was measured.
Test Conditions
Measurement temperature: −40° C.
Shear rate: 0.1 to 100 $s^{-1}$
Evaluation Item
Maximum shear stress at shear rate of 10 $s^{-1}$ or less.
Criteria
Excellent Low-temperature property accepted: maximum shear stress less than 20000 Pa
Good Low-temperature property accepted: maximum shear stress less than 30000 Pa
Poor Low-temperature property failed: maximum shear stress 30000 Pa or more
Very poor Low-temperature property failed: maximum shear stress 40000 Pa or more <Evaluation of Heat Resistance by High-Temperature Thin-Film Test>

Test Method
Grease was evenly applied to a steel plate at a thickness of 2 mm and left to stand in a constant temperature bath at specified temperature for specified time, and then an evaporation amount of the grease was measured.
Test Condition
Test temperature: 120° C.
Test time: 250 h
Criteria
Excellent Heat resistance accepted: evaporation amount less than 2.0 mass %
Good Heat resistance accepted: evaporation amount less than 3.0 mass %
Poor Heat resistance failed: evaporation amount 3.0 mass % or more
Very poor Heat resistance failed: evaporation amount 4.0 mass % or more
Results are illustrated in Tables 1 and 2.

TABLE 1

| | | Example | | | | | | |
|---|---|---|---|---|---|---|---|---|
| | | 1 | 2 | 3 | 4 | 5 | 6 | 7 |
| Thickener | Aliphatic diurea, mass ratio | 90 | 90 | 90 | 90 | 90 | 90 | 50 |
| | Aromatic diurea, mass ratio | 10 | 10 | 10 | 10 | 10 | 10 | 50 |
| | Mass % | 16.0 | 13.5 | 11.0 | 13.5 | 13.5 | 13.5 | 18.0 |
| Base oil | PAO type | PAO-A | PAO-A | PAO-A | PAO-A | PAO-A | PAO-A | PAO-A |
| | mass ratio | 20 | 20 | 20 | — | 30 | 20 | 20 |
| | | PAO-B | PAO-B | PAO-B | PAO-B | PAO-B | PAO-B | PAO-B |
| | | 60 | 60 | 60 | — | 50 | 80 | 60 |
| | | PAO-C | PAO-C | PAO-C | PAO-C | PAO-C | PAO-C | PAO-C |
| | | — | — | — | 100 | — | — | — |
| | | PAO-D | PAO-D | PAO-D | PAO-D | PAO-D | PAO-D | PAO-D |
| | | — | — | — | — | — | — | — |
| | Mineral oil type | MO-A | MO-A | MO-A | MO-A | MO-A | MO-A | MO-A |
| | mass ratio | 20 | 20 | 20 | — | 20 | — | 20 |
| | | MO-B | MO-B | MO-B | MO-B | MO-B | MO-B | MO-B |
| | | — | — | — | — | — | — | — |
| | Kinematic viscosity, $mm^2/s$ | 13.6 | 13.6 | 13.6 | 4.0 | 19.0 | 13.6 | 13.6 |
| | Pour point, ° C. | −30.0 | −30.0 | −30.0 | −65.0 | −30.0 | −45.0 | −30.0 |
| Penetration | | 220 | 250 | 280 | 250 | 250 | 250 | 250 |
| Adhesiveness | | Excellent | Excellent | Good | Good | Excellent | Excellent | Good |
| Low-temperature property | | Good | Excellent | Excellent | Excellent | Good | Excellent | Good |
| Heat resistance | | Excellent | Excellent | Good | Good | Excellent | Excellent | Excellent |

TABLE 2

| | | Comparative Example | | | | | | | |
|---|---|---|---|---|---|---|---|---|---|
| | | 1 | 2 | 3 | 4 | 5 | 6 | 7 | 8 |
| Thickener | Aliphatic diurea, mass ratio | 100 | 0 | 90 | 90 | 90 | 90 | 90 | 90 |
| | Aromatic diurea, mass ratio | 0 | 100 | 10 | 10 | 10 | 10 | 10 | 10 |
| | Mass % | 10.0 | 20.0 | 18.0 | 10.0 | 13.5 | 13.5 | 13.5 | 13.5 |
| Base oil | PAO type | PAO-A | PAO-A | PAO-A | PAO-A | PAO-A | PAO-A | PAO-A | PAO-A |
| | mass ratio | 20 | 20 | 20 | 20 | — | 30 | 10 | — |
| | | PAO-B | PAO-B | PAO-B | PAO-B | PAO-B | PAO-B | PAO-B | PAO-B |
| | | 60 | 60 | 60 | 60 | — | 45 | 40 | — |
| | | PAO-C | PAO-C | PAO-C | PAO-C | PAO-C | PAO-C | PAO-C | PAO-C |

TABLE 2-continued

| | Comparative Example | | | | | | | |
|---|---|---|---|---|---|---|---|---|
| | 1 | 2 | 3 | 4 | 5 | 6 | 7 | 8 |
| | — | — | — | — | 50 | 5 | — | — |
| | PAO-D | PAO-D | PAO-D | PAO-D | PAO-D | PAO-D | PAO-D | PAO-D |
| | — | — | — | — | 50 | — | — | — |
| Mineral oil type | MO-A | MO-A | MO-A | MO-A | MO-A | MO-A | MO-A | MO-A |
| mass ratio | 20 | 20 | 20 | 20 | — | 20 | 40 | 80 |
| | MO-B | MO-B | MO-B | MO-B | MO-B | MO-B | MO-B | MO-B |
| | — | — | — | — | — | — | 10 | 20 |
| Kinematic viscosity $mm^2/s$ | 13.6 | 13.6 | 13.6 | 13.6 | 3.0 | 20.0 | 13.6 | 13.6 |
| Pour point, ° C. | −30.0 | −30.0 | −30.0 | −30.0 | −65.0> | −30.0 | −25.0 | −12.5 |
| Penetration | 250 | 250 | 200 | 300 | 250 | 250 | 250 | 250 |
| Adhesiveness | Very poor | Very poor | Excellent | Poor | Good | Excellent | Excellent | Good |
| Low-temperature property | Excellent | Poor | Poor | Excellent | Excellent | Poor | Poor | Very poor |
| Heat resistance | Excellent | Excellent | Excellent | Good | Poor | Excellent | Poor | Very poor |

What is claimed is:

1. A grease composition for a speed reducer part of an on-vehicle electric component, the grease composition containing a base oil and a thickener, wherein the base oil is a mixed oil of a poly-α-olefin having a kinematic viscosity of 4 to 100 $mm^2/s$ at 100° C. and a mineral oil having a kinematic viscosity of 6 to 15 $mm^2/s$ at 100° C., the base oil has a kinematic viscosity of 8 to 15 $mm^2/s$ at 100° C. and a pour point of −30° C. or lower, the thickener is a mixture of a diurea compound expressed by formula (1) and a diurea compound expressed by formula (2)

$$R_1—NHCONH—R_2—NHCONH—R_1 \quad (1)$$

$$R_3—NHCONH—R_2—NHCONH—R_3 \quad (2)$$

wherein $R_1$ is a straight-chain alkyl group having 8 or 18 carbon atoms, $R_2$ is a divalent aromatic hydrocarbon group having 6 to 15 carbon atoms, and $R_3$ is an aryl group having 6 to 7 carbon atoms, the mass ratio of the diurea compound expressed by formula (1) to the diurea compound expressed by formula (2) is 9:1 to 8:2, and a penetration of the grease composition is 220 to 280.

2. The grease composition according to claim 1, further comprising an antioxidant and an antirust agent.

3. The grease composition according to claim 1, wherein the penetration is 235 to 265.

4. The grease composition according to claim 1, wherein a content of the base oil in the grease composition is 70 to 90 mass %.

5. The grease composition according to claim 1, wherein a content of the thickener in the grease composition is 5 to 30 mass %.

6. A grease composition comprising a base oil and a thickener, wherein:

the base oil is poly-α-olefin or a mixed oil of a poly-α-olefin and a mineral oil having a kinematic viscosity of 13.6 $mm^2/s$ at 100° C. and a pour point of −30° C. or lower, the thickener is a mixture of a compound of formula (1) in which $R_1$ is a straight-chain alkyl group having 8 carbon atoms and $R_2$ is a group derived from diphenylmethane-4,4'-diisocyanate, and a compound of formula (2) in which $R_3$ is a tolyl group and $R_2$ is a group derived from diphenylmethane-4,4'-diisocyanate, where a mixing ratio is (1):(2)=9:1 in mass ratio, $$R_1—NHCONH—R_2—NHCONH—R_1 \quad (1)$$

$$R_3—NHCONH—R_2—NHCONH—R_3 \quad (2)$$

and a penetration of the grease composition is 250.

7. The grease composition according to claim 6, further comprising 0.5 mass % of a phenol-based antioxidant and 0.5 mass % of a succinic anhydride including an alkenyl group having 12 carbon atoms as an antirust agent.

* * * * *